United States Patent [19]

Kawaguchi et al.

[11] Patent Number: 4,942,960

[45] **Date of Patent: * Jul. 24, 1990**

[54] METHOD OF PRESERVING WINE IN A BOTTLE AND A WINE PRESERVING CONTAINER

[76] Inventors: Tomihisa Kawaguchi, 8-13, Jinmyo-cho 1-chome; Akira Ota, 1-7, Okano-cho; Akira Kawasaki, 5-2, Goban-cho, all of Kamo-shi, Niigata-ken, Japan

[ * ] Notice: The portion of the term of this patent subsequent to Jul. 25, 2006 has been disclaimed.

[21] Appl. No.: 333,306

[22] Filed: Apr. 5, 1989

Related U.S. Application Data

[63] Continuation of Ser. No. 111,716, Oct. 23, 1987, Pat. No. 4,850,480.

[30] Foreign Application Priority Data

Dec. 19, 1986 [JP] Japan ..... 61-303463
Sep. 21, 1987 [JP] Japan ..... 62-143990[U]

[51] Int. Cl.[5] ..... B65D 81/00

[52] U.S. Cl. ..... 206/205; 99/277.1; 215/12.2; 215/13.1; 426/124

[58] Field of Search ..... 426/418, 124, 394, 397; 206/0.5, 204, 205; 215/12.1, 12.2, 13.1; 220/DIG. 12, 14; 99/275, 276, 277.1, 278

[56] References Cited

U.S. PATENT DOCUMENTS

| | | | |
|---|---|---|---|
| 3,081,137 | 3/1963 | Kolokythas | 426/398 |
| 3,120,319 | 2/1964 | Buddras | 215/12.2 |
| 3,250,416 | 5/1966 | Clarke | 215/12.2 |
| 3,472,568 | 10/1969 | Southwick | 312/31 |
| 4,124,141 | 11/1978 | Armentrout et al. | 426/124 |
| 4,232,532 | 11/1980 | Marsh | 62/457 |
| 4,265,097 | 5/1981 | Bordas et al. | 62/438 |
| 4,272,969 | 6/1981 | Schwitzgebel | 62/91 |
| 4,454,945 | 6/1984 | Jabarin et al. | 426/124 |

FOREIGN PATENT DOCUMENTS

| | | | |
|---|---|---|---|
| 2616502 | 10/1977 | Fed. Rep. of Germany | 215/13.1 |
| 8427336 | 1/1985 | Fed. Rep. of Germany . | |
| 1363467 | 5/1964 | France . | |
| 1583923 | 12/1969 | France . | |

*Primary Examiner*—Virginia Manoharan
*Attorney, Agent, or Firm*—Oblon, Spivak, McClelland, Maier & Neustadt

[57] ABSTRACT

A bottle of wine is received in a container with a cover, both being made of foamed polystyrene. Polyacrylate, as a water-absorbing material moist with water, is put in the inner space defined by the container and the cover to impart a nearly constant humid condition in the inner space.

1 Claim, 7 Drawing Sheets

METHOD OF PRESERVING WINE IN A BOTTLE AND A WINE PRESERVING CONTAINER

This is a continuation of Ser. No. 111,716, filed Oct. 23, 1987, now U.S. Pat. No. 4,850,480.

The present invention relates to a method of preserving a bottle of wine and a wine preserving container for preventing reduction in the quality of bottled wine and keeping its flavor.

Wine is generally sold in the form of bottled wine in stores, shops, etc. Bottles containing wine are generally corked, and mouth portions are sealed by an aluminum foil. In many cases, a bottle or plural bottles of wine are packed by a packing material such as a fancy box when they are sold. However, they are uncovered and are kept at a desired place such as a shelf or a box in home.

In such bottled wine sealed with the cork and the aluminum foil, moisture and oxygen in the atmosphere communicate with the inside of the bottle through the corke when the corke is dried up in a dry season, whereby bouquet and flavor of wine are lost. Particularly, the above-mentioned phenomenon takes place in the summer and the winter in which change in humidity and temperature in the atmosphere is remarkable to thereby decrease the quality of wine.

It is an object of the present invention to eliminate the above-mentioned problem and to provide a method of preserving wine in a bottle and a wine preserving container capable of maintaning the quality of wine effectively without imparing its flavor when bottled wine is preserved at stores, restaurants or homes.

The foregoing and the other objects of the present invention have been attained by providing a method of preserving wine which comprises putting at least one bottle of wine in a container with a cover made of a heat insulating foamed material together with a water-absorbing material in a wet condition to thereby impart a nearly constant humid condition in the container.

Further, the above-mentioned objects have been attained by providing a wine preserving container which comprises a container main body made of a heat insulating foamed material which is adapted to receive at least one bottle of wine, and a cover to be put on the main body, wherein a space to receive a predetermined amount of water-absorbing material is formed in either the main body or the cover.

In the present invention, a foamed material of a thermoplastic rigid resin having a closed cell structure, such as polystyrene, polypropylene, crosslinked polyethylene, is used for the container.

As a water-absorbing material, water-absorptive non-woven polymer fabric or highly water-absorptive polymer powder is used. The non-woven polymer fabric is prepared in such a manner that an aqueous solution of polymerizable monomer having acrylic acid as the main component (hereinbelow, referred to as acrylate monomer) which is obtained by neutralizing 20% or more of carboxyl group in alkali metal salt or ammonium, is impregnated in a shaped fibrous substance; the acrylate monomer is polymerized to obtain highly water-absorptive polymer, and then, the polymer is deposited on the fibrous substance. Specifically, a crosslinking agent and an oxidative radical polymerization initiator are mixed and dissolved in the aqueous solution of the acrylate monomer, and the mixed solution is sprayed for impregnation on the fibrous substance under the condition of room temperature so that the particle size of the highly water-absorptive polymer is in a range of 30 μm–500 μm, and thereafter, a reducing agent is added in the form of mist for polymerization.

As the highly water-absorptive polymer capable of absorbing an amount of 20 g–2000 g of water per 1 g of resin, a polyacrylic acid sodium salt, acrylic acid soda salt draft polyvinyl alcohol, a chloropropionic acid sodium salt of carboxymethyl cellulose, a hydroxyethyl type polymer, hydroxydized acrylonitrile draft starch are preferably used.

In the method of the present invention, water is previously absorbed in the water-absorbing material at an amount of 5 g–20 g of water per 1 g of the water-absorbing material, preferably, 10 g of the water per 1 g of the water-absorbing material, and it is put in the container or the cover so that the water-absorbing material occupies in the inner space (containing a bottle or bottles) defined by the container and the cover at an amount of 5 g–100 g per 1 l in volume of the inner space.

Preferred embodiments of the present invention will be described with reference to the drawings.

Figure 1:
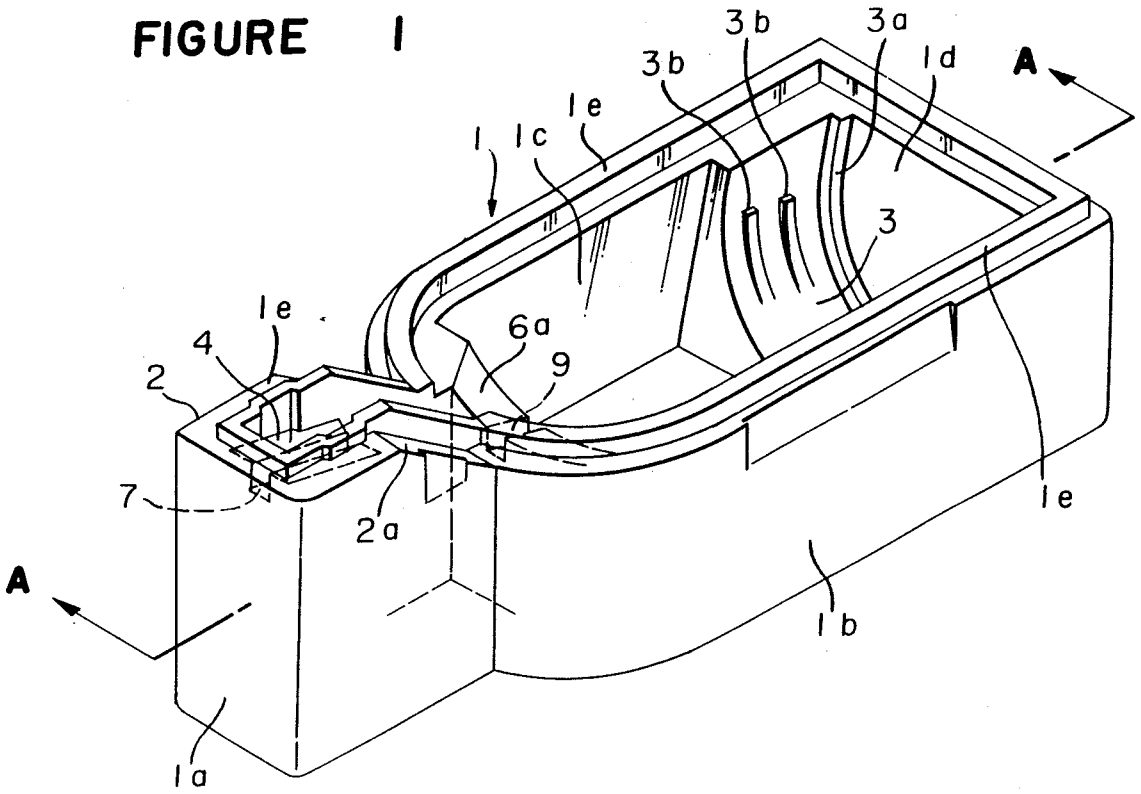
FIG. 1 is a perspective view of an embodiment of the main body of a wine preserving container according to the present invention.

In FIG. 1, a reference numeral 1 designates a container main body formed by heat insulating foamed polystyrene, having a closed cell structure, which is adapted to receive a bottle of wine. In the main body, the depth at one end portion (at the right side in FIG. 1) in the longitudinal direction of the main body is made greater than the other end portion so that the bottle is in a inclined state (preferably at an angle of 10°–20° with respect to the horizontal plane).

At the other end of the container main body 1, there is a receiving portion 2 in which the mouth portion and the neck portion of the bottle are received. A front end wall 1*a* (at the left side in FIG. 1) and each left end part (at the side of the receiving portion 2) of side walls 1*b*, 1*c* contiguous to the front end wall 1*a* are made higher than the rear end part of the side walls 1*b*, 1*c* and the rear end wall 1*d* contiguous to the side walls 1*b*, 1*c*, and they are formed to be two third as high as the front end wall 1*a*. On the upper surface of the front and rear end walls 1*a*, 1*d*, the side walls 1*b*, 1*c* and a pair of inclined portions 2*b*, there is provided a strip-like projection 1*e* which is fitted to a corresponding groove formed in a cover which will be described below. The inclined portions 2*a* incline downwardly from the receiving portion toward the both side walls of the trunk portion of the bottle.

At the other end portion (at the right end portion in FIG. 1) of the main body 1, a recess 3 is formed inside the rear end wall 1*d* so that the bottom portion of a bottle is fitted. An arched projection 3*a* is formed in the recess 3 near the rear end wall 1*d*, whereby a bottle having a small diameter can be supported on it. Also, a pair of arched projections 3*b* are formed in the recess 3 to support the outer periphery of the bottle. On the other hand, a concave 4 is formed in the receiving portion 2 near the front end wall 1*a* to surround the mouth portion of the bottle. The concave 4 has its bottom downwardly inclined from the front end wall 1*a* toward the right side. The receiving portion 2 is provided with a partition chamber 5 which is communicated with the concave 4 and is defined by partition wall 6 from the major portion of the container main body 1. The upper edge 6*a* of the partition wall 6 has a curved recess so that the shoulder portion of the bottle is received in close-contact therewith. A longitudinal groove 7 is formed in the concave 4 so as to extend from the inner side of the front end wall 1*a*. The groove 7 communicates with the partition chamber 5.

A predetermined amount of a water-absorbing material 8 of a water-absorptive non-woven polymer fabric is received in the partition chamber 5 in a state that a suitable amount of water is contained, whereby at least an area around the mouth portion of the wine bottle is always surrounded by saturated water vapor irrespective of the atmospheric temperature, with the result that a cork is prevented from becoming dry, and evaporation and oxidization of wine is prevented.

As the water-absorbing material 8, DIAWET (tradename) commercialized by Mitsubishi Petrochemical Co., Ltd. as a polyacrylic acid sodium salt, i.e. a highly water-absorptive polymer having ability of water absorption of 860 cc/g, or GORE-TEX (tradename) commercialized by Japan Gore-tex Incorporation as a wetting agent which unnecessitates incorporation of water may be used.

Figure 2:
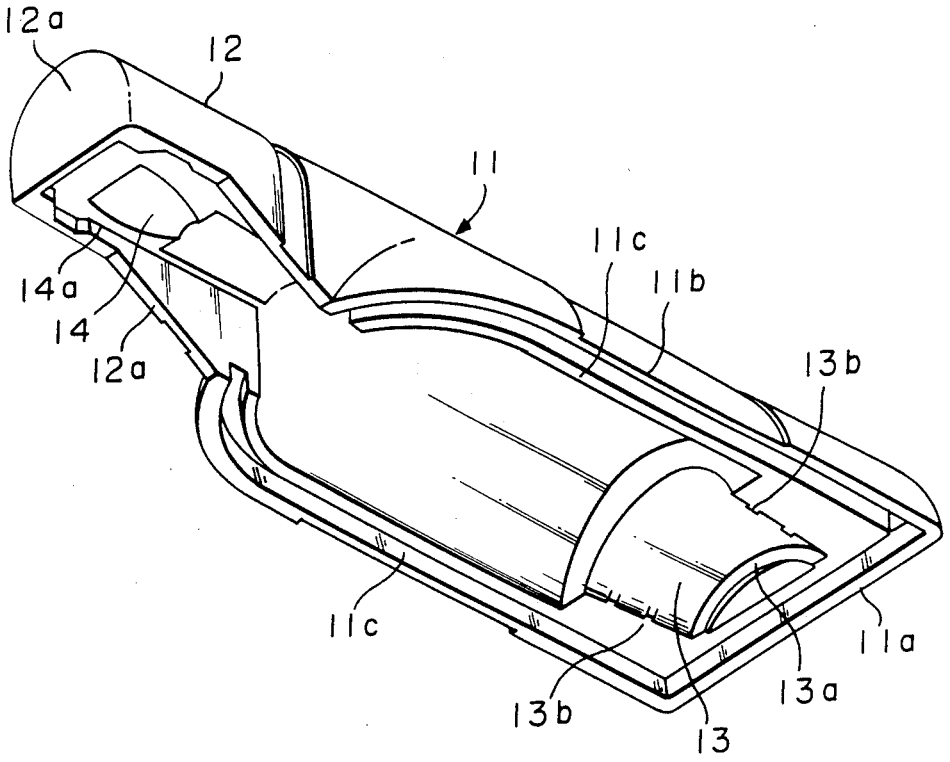
FIG. 2 is a perspective view of an embodiment of a cover as a constituent element of the container of the present invention.

FIG. 2 shows a cover 11 formed by the same heat insulating formed material having a closed cell structure as the container main body 1. The cover 11 has a shape matching to the main body 1. One end portion (the left end part in FIG. 2) of the cover is made lower than the other portions, and one end portion constitutes a covering part 12 for covering the neck portion of the bottle. The covering part 12 is generally in a semi-circular cylindrical form. The other portions of the cover is in a semi-circular cylindrical form having a diameter which is two times greater than that of the covering part 12. A pair of slant portions 12*a* are formed extending downwardly in the covering part 12 so that they are fitted to the inclined portions 2*a* of the main body 1.

At the other end (the right end part in FIG. 2) of the cover 11, there is formed a recess 13 which extends from the inner side of the rear end wall 11*a* of the cover 11 and which covers the bottom of the bottle. An arched projection 13*a* is formed in the recess 13 at a position in correspondence to the arched projection 3*a* in the main body 11. Projections 3*b* is formed in the recess 3 so as to be in contact with the outer periphery of the bottle to support it.

A concave 14 is formed in the covering part 14 so as to correspond to the concave 4 of the main body 1. The concave 14 is inwardly and downwardly recessed from the vicinity of the inner part of the front end wall 12*a* of the covering part 12 so that the concave 14 comes in contact with the peripheral face of the bottle at the position near the mouth portion. A step portion 14*a* is formed at the inside of the other end side of the covering part 12 so that the shoulder portion 14*a* is fitted to the strip-like projection 1*a* of the receiving portion 2 of the main body 1. A groove 11*c* is also formed in the edge 11*b*, which forms an opening of the cover 11, except for the edge 11*b* in the covering part 12 so that the groove 11*c* is fitted to the strip-like projection le of the main body 1.

Figure 3:
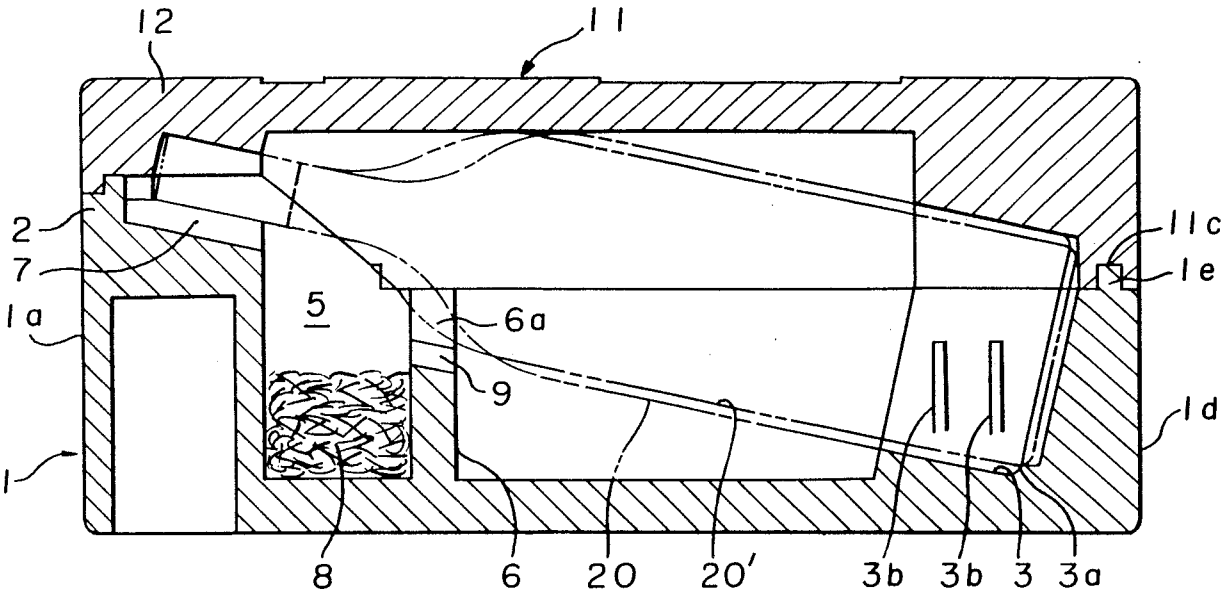
FIG. 3 is a longitudinal cross-sectional view taken along a line A—A of the main body with the cover as shown in FIGS. 1 and 2.

The function of the preserving container having the construction as above-mentioned will be described. A bottle of wine with a cork and an aluminum foil for sealing the mouth portion of the bottle is placed in the recess 3 of the main body 1 with the bottom of the bottle being placed inside the arched projection 3*a*, when the bottle having a large diameter is put. Or, a bottle of wine is mounted on the arched projection 3*a*, when the bottle having a small diameter 20′ is put. The mouth portion of the bottle is fitted in the concave 4 formed near the front end wall 1*a*. Then, the bottle having the large diameter 20 or the small diameter 20′ is received in the main body 1 in a state slightly inclined. Then, the cork fitted to the mouth portion becomes wet by wine contained in the bottle. The cover 11 is put on the main body 1 with the groove 11*c* being fitted into the strip-like projection 1*e* of the main body 1. FIG. 3 shows that the bottle of wine is stably received in the container 1 in which the bottom of the bottle 20 or 20′ is held by the recesses 3, 13 formed in the main body and the cover 11, and at the same time, the peripheral portion of the bottle is held by the arched projections 3*a* and 13*a* so as not to cause lateral movement of the bottle. In addition, the mouth portion of the bottle is surrounded by the concaves 14, 15.

On the other hand, the shoulder portion of the bottle is in close-contact with the upper edge 6*a* of the curved recess of the partition wall 6, and the inner surface of the cover 11 is in close-contact with a peripheral portion of the bottle, whereby a space surrounding the trunk portion and the bottom of the bottle is isolated from the partition chamber 5 containing the water-absorbing material 8, which communicates only with the receiving part 2 and the covering part 12 through the longitudinal groove 7.

When the ambient temperature becomes high, namely, the temperature of an area around the mouth portion of the bottle becomes high in a summer season, water contained in the water-absorbing material 8 in the partition chamber 5 evaporates to the extent that a quantity of saturated vapor is determined by the temperature of air. On the contrary, when the temperature of air around the mouth portion becomes low in a winter season, an excessive-amount of water vapor in air condensates and is absorbed in water-absorbing material. Thus, the water in the water-absorbing material 8 evaporates or vapor in the air is condensed depending on change in the temperature so that the absolute humidity in the container is kept to be substantially constant, for instance in a range of 65%–85%. Accordingly, air containing saturated vapor can be maintained at at least the mouth portion of the bottle. Therefore, a phenomenon that the cork is dried up or wine evaporates can be effectively prevented.

In the container as shown in FIGS. 1–3, since there are formed the inclined portions 2a in the receiving part 2 of the main body 1 and the inclined portions 12a of the covering part 12 of the cover at each outer half portion of the edge surfaces which are in confrontantion with each other, the operations for fitting or removing the cover become easy, and a risk of breakage of the covering part of the 12 at its root portion can be eliminated. Further, a groove 9 may be formed in the upper edge 6a of the partition wall 6 to communicate the interior of the main body 1 with the partition chamber 5.

Figure 4:
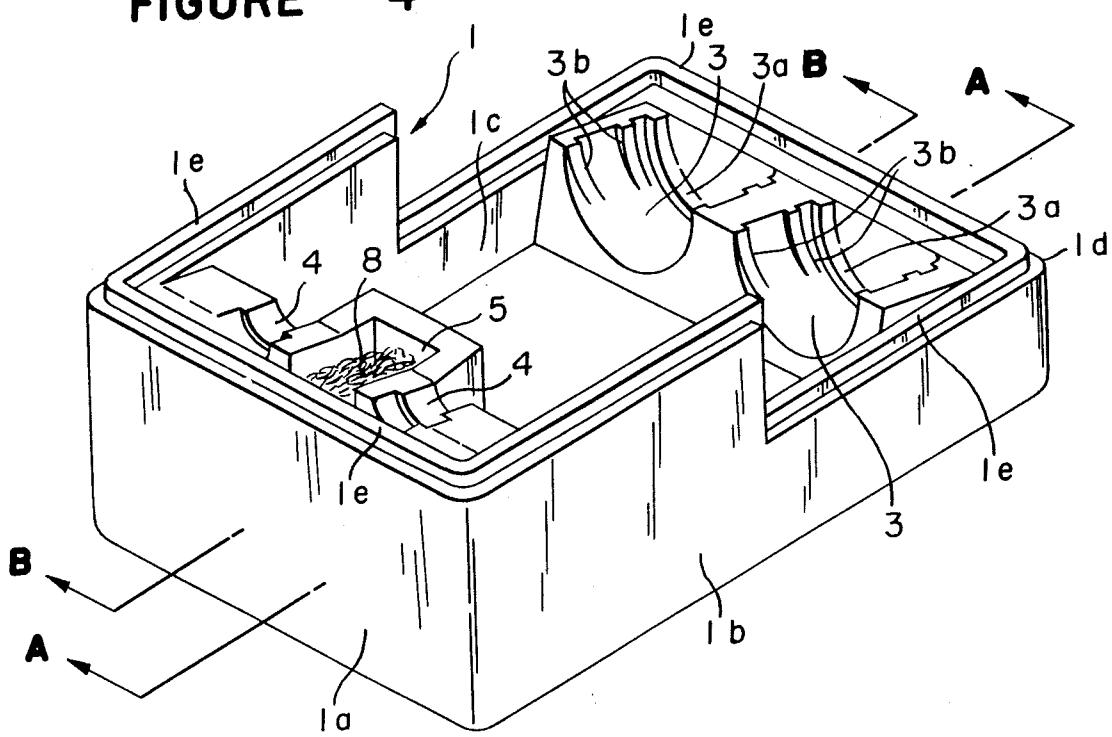
FIG. 4 is a perspective view of a second embodiment of the container main body according to the present invention.
Figure 5:
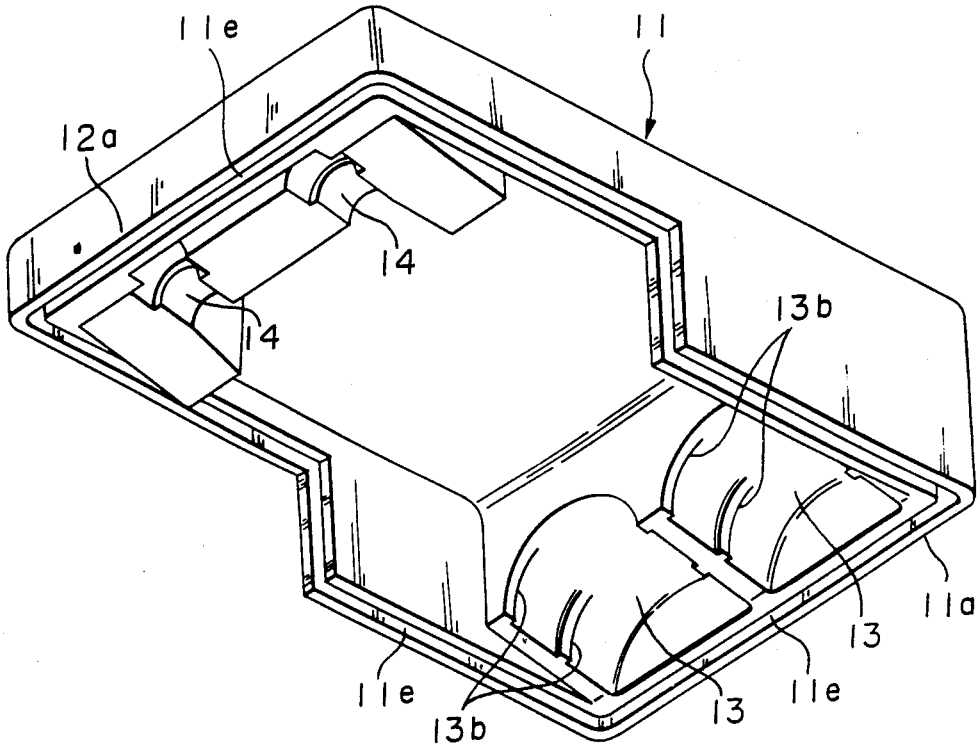
FIG. 5 is a perspective view of the second embodiment of the cover to be assembled with the main body shown in FIG. 4.

FIGS. 4 and 5 show a second embodiment of the wine preserving container according to the present invention. The second embodiment is substantially the same as the first embodiment except that the shape of the main body 1 and the cover 11 is generally box-like because two bottles of wine are received in a parallel position and a single partition chamber for receiving the water-absorbing material is formed between the mouth portions of the two bottles. Accordingly, the same reference numerals designate the same or corresponding parts. In FIGS. 4 and 5, a numeral 11e designate a peripheral groove which fits the peripheral projection 1e of the main body.

Figure 6:
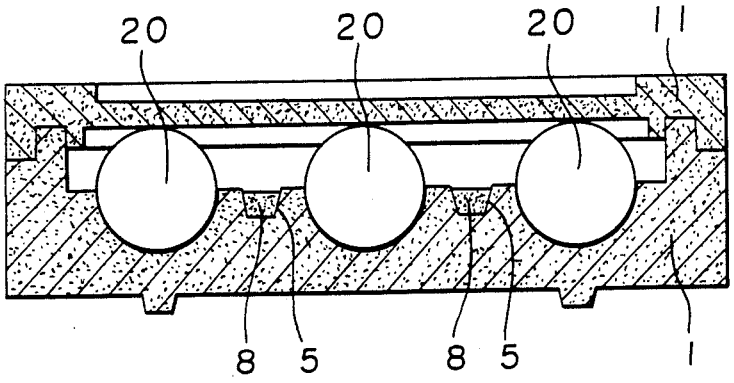
FIG. 6 is a transverse cross-sectional view of a third embodiment of the main body and the cover of the present invention.

FIG. 6 is a transverse cross-sectional view showing a third embodiment of the wine preserving container according to the present invention. The container is adapted to receive three bottles of wine in a parallel position, and partition chambers 5 each receiving the water-absorbing material 8 are formed between the adjacent bottles. The shape of the container and the arrangement of the constituent elements are the same as in the second embodiment. The second and third embodiments provide the same function and effect as the first embodiment.

Figure 7:
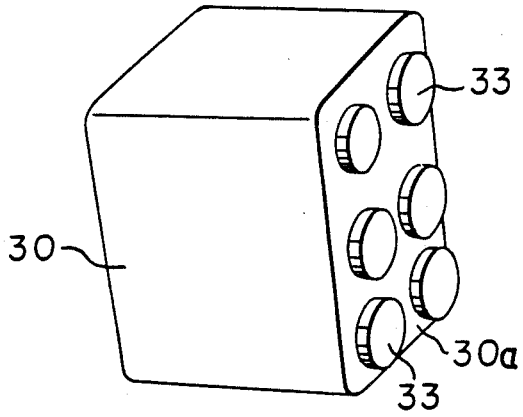
FIG. 7 is a perspective view of a fourth embodiment of the wine preserving container of the present invention.
Figure 8:
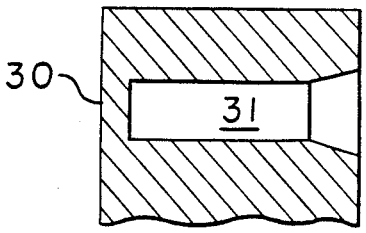
FIG. 8 is an enlarged cross-sectional view partly broken of the main body of the container shown in FIG. 7.
Figure 9:
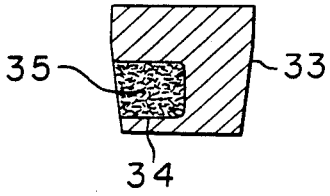
FIG. 9 is an enlarged cross-sectional view partly broken of the cover shown in FIG. 7.

FIGS. 7 to 9 show a fourth embodiment of the wine preserving container according to the present invention. The main body 30 of the container is made of the same material as the above-mentioned embodiments. Six holes 31 are formed independently in a side surface 30a of the main body 30 to extend lateraly. A cover 33 is adapted to be fitted into each of the holes 31 and is made of cork. The cover may be made of the same material as the main body 30. In each of the covers 31, a recess 34 is formed in one side portion which is inserted into the main body 30 and the same water-absorbing material as used in above-mentioned embodiments is received in the recess 34. The cover may be of a single piece to cover the entire side surface 30a of the main body and recesses are formed in correspondence to the holes 31 of the main body.

The fourth embodiment provides the following effect besides that of the first to third embodiments. Since each of the bottles is received in each of the holes formed in the main body 30, breakage of the bottles which may result during their transportation or storage in a stacked form can be prevented. Further, since the water-absorbing material is put in the recess of each of the covers, replacement of the material can be easy. Accordingly, it is effective as a preserving container and avoids change in quality of bottled wine.

Tests for preserving bottled wine were unofficially conducted.

A container of a molded product obtained by molding pre-foamed polystyren beads was used. The container had a density of 26 g/l and received 6 bottles of wine. As a water-absorbing material, 30 g of DIAWET A (tradename, commercialized by Mitsubishi Petrochemical Co., Ltd., water absorption of 860 cc/g) which is polyacrylate as a highly water-absorptive polymer was used. The material contained 300 cc of water.

As samples, the following bottles of wine were prepared.

1. Chateau Bouscaut, 1980 (high grade red wine, 750 cc): 12
2. Chateau Lion, 1980 (general grade white wine, 750 cc): 12
3. Chateau Monbousquet, 1982(red, Saint-Emilion): 12
4. Clos Saint-Denis, 1977 (red, Domaine Dujac): 12
5. Simi Chardonnay, 1981 (white, California): 12

Each 12 bottles of wine as mentioned in the above 1 and 2 were from a retail shop on May 1, 1986, and each 6 bottles were preserved on the same day according to the method of the present invention for 6 months and each 6 bottles were kept under ordinary condition of preservation for 6 months. Then, the bottled wine of the 24 bottles were tested by 30 persons. For the high grade red wine, the all person appreciated that the bottled wine preserved according to the method of present invention have good bouquet and flavor. With respect to the general grade white wine, 27 persons appreciated them.

The bottled wine as mentioned in 3–5 were got on May 1, 1986. Each 6 bottles were preserved according to the method of the present invention by Sept. 23, 1987 and each 6 bottles were preserved under the ordinary condition of preservation by Sept. 23, 1987. They were tested by 30 persons and the all persons appreciated the bottled wine preserved by the method of the present invention. Thus, it was found that there was no change in quality of the bottled wine preserved according to the present invention and there was aging effect.

As described above, in accordance with the present invention, wine is certainly protected from its deterioration due to change in temperature and humidity. Since the container has heat insulating properties and humidity adjusting function, the wine is maintained to have a good quality as well as ageing effect during its preservation. The preserving method of the present invention is easily applicable in stores, shops, homes and any transportation stages. Therefore, the present invention is greatly valuable in practical use.

We claim:

1. A wine preserving container which comprises: a container main body made of a heat insulating foamed material for receiving at least one bottle of wine; a cover made of said heat insulating foamed material to be put on said main body; a partition wall provided in said main body to form a partition chamber; a predetermined amount of water-absorbing material received in said partition chamber; concave means for receiving the neck portion of at least one bottle of wine at one end of said main body and said cover; and recess means for receiving the bottom portion of the at least one bottle of wine, wherein said partition chamber is formed in said main body so that said concave means are communicated with said recess means, a partition recess is formed at the upper edge of said partition wall to receive the shoulder portion of the at least one bottle of wine, and at least one projection is formed in said main body to support the bottom portion of the at least one bottle of wine so as not to cause lateral movement of the bottle, and wherein said heat insulating foamed material and said water absorbing material together impart a constant humid condition in said container.

* * * * *